US011846212B2

(12) United States Patent
Passow et al.

(10) Patent No.: US 11,846,212 B2
(45) Date of Patent: Dec. 19, 2023

(54) VALVE STEM SEAL

(71) Applicant: AKTIEBOLAGET SKF, Gothenburg (SE)

(72) Inventors: Christoph Passow, Leichlingen (DE); Hans-Dieter Zander, Cologne (DE)

(73) Assignee: AKTIEBOLAGET SKF, Gothenburg (SE)

( * ) Notice: Subject to any disclaimer, the term of this patent is extended or adjusted under 35 U.S.C. 154(b) by 0 days.

(21) Appl. No.: 17/809,347

(22) Filed: Jun. 28, 2022

(65) Prior Publication Data

US 2023/0021872 A1 Jan. 26, 2023

(30) Foreign Application Priority Data

Jul. 23, 2021 (DE) ..... 102021207916.4

(51) Int. Cl.
*F01D 1/02* (2006.01)
*F01L 3/08* (2006.01)

(52) U.S. Cl.
CPC ..... *F01L 3/08* (2013.01)

(58) Field of Classification Search
CPC ..... F01L 3/08; F01L 2301/00; F16K 41/04
USPC ..... 123/188.6
See application file for complete search history.

(56) References Cited

U.S. PATENT DOCUMENTS 5,553,869 A * 9/1996 Stamback ..... F01L 3/08 277/502
6,209,504 B1 * 4/2001 Hegemier ..... F01L 3/08 123/188.6
6,752,398 B1 * 6/2004 McArthy ..... F02F 11/002 123/188.8
6,877,719 B2 * 4/2005 Heinl ..... F01L 3/08 123/190.17
7,025,030 B2 * 4/2006 Leimer ..... F01L 3/08 277/502
8,011,669 B2 9/2011 Sakata et al.
8,764,019 B2 * 7/2014 Zoppi ..... F01L 3/08 277/502
9,416,690 B2 * 8/2016 London ..... F01L 3/08
10,072,539 B2 * 9/2018 Hesher ..... F16K 41/08
2005/0040603 A1 * 2/2005 Leimer ..... F01L 3/08 277/502
2013/0200574 A1 * 8/2013 Hegemier ..... F01L 3/08 277/502

* cited by examiner

*Primary Examiner* — Long T Tran
*Assistant Examiner* — James J Kim
(74) *Attorney, Agent, or Firm* — J-TEK LAW PLLC; Scott T. Wakeman; Mark A. Ussai

(57) ABSTRACT

A valve stem seal includes an elastomeric annular seal body including a first seal body section and a second seal body section. The first seal body section includes a first seal lip configured to sealingly abut against the valve stem to delimit an oil space and a second seal lip axially spaced from the first seal lip and configured to sealingly abut against the valve stem to delimit an air space. The first seal body section includes an annular channel in a radially inner wall between the first seal lip and the second seal lip that is spaced from the valve stem when the valve stem seal is mounted on the valve stem, and the surface of the channel includes an undercut configured to facilitate a deformation of the second seal lip toward the first seal lip.

18 Claims, 2 Drawing Sheets

VALVE STEM SEAL

CROSS-REFERENCE

This application claims priority to German patent application no. 10 2021 207 916.4 filed on Jul. 23, 2021, the contents of which are fully incorporated herein by reference.

TECHNOLOGICAL FIELD

The present invention relates to a valve stem seal having first and second seal body sections for providing improved sealing.

BACKGROUND

Valve stem seals are used in a variety of combustion engines, for example, in automobiles, in trucks, or in motorcycles, and serve to keep oil that is circulating in the valve cover, which is needed for lubricating the camshafts or the like, away from the combustion chamber and the intake tract, as well as to prevent exhaust gas or gas mixture under overpressure from reaching into the valve cover when the valve is open.

Due to the increased use of turbochargers and compressors in automobiles, situations more frequently arise in which the gas pressure on the side of the valve or of the valve stem seal facing the cylinder is significantly greater than the ambient pressure normally prevailing in the valve cover.

For some types of combustion engines, such as, for example, modern automobile motors, valve stem seals must be able to withstand pressures of a plurality of bar during motor braking operation.

The valve stem seal itself is usually manufactured from an elastomer material and includes a seal body that sealingly abuts against the valve stem and/or a valve stem guide guiding the valve stem, so that a gas space is separated from an oil space. For this purpose the seals can comprise a gas lip that is oriented toward the gas-space side, an oil lip that is oriented toward the oil side, and a reinforced rubber bead for a secure hold on the valve stem guide. However, with the higher pressures occurring in the truck sector, for example, starting at 15 bar, the seal can separate from the guide. In addition, the elastomer material of the seal can itself tear, possibly with the result that higher forces can no longer be transmitted. Over time the elastomer material can also become brittle, for example, due to temperature or environmental influences, and its retaining force thereby be negatively affected.

Furthermore, the valve stem seal can include a reinforcing element that is configured on the one hand to stabilize the shape of the valve stem seal itself, and on the other hand to improve the seat in the valve stem guide. This design can also be operated at increased pressure since the elastomer of the valve stem seal is clamped in the installed state. However, the reinforcing element increases the risk of the elastomer material tearing since it represents an additional movement limitation.

SUMMARY

It is therefore an aspect of the present disclosure to provide a valve stem seal that reliably prevents tearing or damage to the elastomer material, even at high pressures.

In the following a valve stem seal is disclosed for sealing a valve stem, in particular in a combustion motor, in particular in a motor vehicle, which includes an annular seal body made from an elastomer material that has a first seal-body section that is configured to seal against a valve stem and a second seal body section that is configured to seal against a valve stem guide guiding the valve stem. Furthermore, at the first seal-body section the valve stem seal includes at least one first seal lip (oil lip) directed essentially axially outward toward an oil space (end of the valve stem) and a second seal lip (gas lip) directed essentially axially inward toward a gas space (the valve stem guide) which are configured to sealingly abut against the valve stem, wherein a free space is provided between the first and second seal lip, in which free space the first seal-body section is spaced from the valve stem.

In order to prevent or to reduce tearing or damage at the second seal lip (gas lip), an undercut is furthermore provided in the free space after the second seal lip, which undercut is configured such that it allows the second seal lip to deform axially outward toward the first seal lip. This ability of the second seal lip to deform in the undercut reduces the compressive and tensile forces acting on the material that can lead to damage.

In this application the terms "after" and "before" used here of a seal lip are to be understood in the direction from gas space to oil space; in other words toward the non-guided end of the valve stem.

Furthermore, it is preferred that the second seal lip is configured as a gas-pressure-relief seal lip, which is configured, in the event of high pressure on the gas-space side, to deform in the undercut and to open toward the free space. Such an opening leads to an in principle undesirable so-called "blowby," i.e. a discharge of gas toward the oil side, but also reduces the pressure on the seal lip and thus the risk of seal lip damage. In addition, this "blowby" only occurs during an operating of the motor in a braking mode, since only then does the pressure on the seal lip lie in the range that permits an opening toward the free space. However, in this case this "blow-by" is harmless since during the motor braking mode no fuel is present in the combustion chamber, but rather air, which is discharged together with the gas escaping from the gas-space side.

It is furthermore preferred here when the first seal lip is configured to open axially outward toward the oil space if a gas pressure in the free space is exceeded. This allows an escape of the gas in the oil space. As described above, this escape of gas usually only occurs during the motor braking mode so that a venting in the oil space is essentially unproblematic. In addition, the "blowby" only occurs very rarely, with the result that a "blowing away" of oil that is necessary for the lubricating of the abutment surface between the oil lip and the valve stem is also largely prevented.

In order to further support and improve the deformation toward the undercut, according to one preferred exemplary embodiment the valve stem seal furthermore includes a slip incline disposed on the gas-space side, which slip incline directs and supports the deformation toward the undercut when pressure is applied.

Furthermore, the slip inclination favors a damage-free installation of the valve stem seal since it facilitates a pushing of the valve stem through the valve stem seal. At the same time, the undercut can make a deformation possible even during installation, and thus also insure a damage-free installation.

According to a further preferred exemplary embodiment, on the outer side facing away from the first seal lip of the first seal-body section a spring element, in particular a worm spring, is disposed that acts upon and preloads the first seal lip with pressure toward the valve stem. An entry of oil toward the gas-space side is thereby reliably reduced.

Furthermore, it is advantageous to provide a reinforcing element that at least partially surrounds the valve stem. The shape of the valve stem seal itself can thereby be stabilized and its seat on the valve stem guide improved. The valve stem seal can thereby be operated even at increased pressure since the elastomer of the valve stem seal is clamped in the installed state. Since the undercut on the second seal lip makes a deformation possible without excessive stress of the elastomer material, a valve stem seal can be provided that both is configured for high pressures and averts the risk of damage of the seal material itself.

Here it is preferred in particular that the reinforcing element radially outwardly surrounds the valve stem seal in the region of the second valve stem seal body and is at least partially embedded in the elastomer material in the region of the first valve stem body. An exemplary embodiment is particularly advantageous here wherein in the region of the first valve stem seal body the reinforcing element is disposed radially outwardly in the region in front of the second seal lip and is bent toward the valve stem in the region of the second seal lip and/or of the undercut and dips into the elastomer material and is completely embedded in the elastomer material in the region of the undercut and/or of the free space. A particularly good stabilizing of the elastomer material can thereby be provided.

According to a further preferred exemplary embodiment, the reinforcing element is configured such that it is angled in the axial direction at its embedded end, preferably in the region of the undercut, and extends essentially axially, preferably to approximately the center of the free space. The angled formation ensures a further deflection of the pressure and tensile forces that act on the elastomer material when pressure is applied so that the loading and thus associated damage to the elastomer material is thereby further prevented.

Furthermore, as a further preferred exemplary embodiment shows, the reinforcing element can be configured as a seat for a spring surrounding the valve stem and axially extend the first valve-seal body radially outward so that it completely surrounds the valve guide and includes a radially outwardly extending flange on an end facing way from the valve stem seal. This makes possible a particularly good and simple abutment of a valve spring. In addition, the spring attaches the entire valve stem seal to the valve stem or the valve stem guide, so that a lifting-away of the valve stem seal per se is prevented at high pressures.

According to a further preferred exemplary embodiment, the valve stem seal includes at least one seal rib on the second seal body section, which seal rib is configured to sealingly abut against the valve stem guide. The gas space can furthermore be sealed thereby, and a "blowby" in the opposite direction to the oil space can also be prevented. It is furthermore preferred here when at least one receptacle, for example, an undercut, is provided on the valve stem guide, in which receptacle the at least one seal rib can engage. Even at high pressure load, this ensures an improved seating of the valve stem seal on the valve stem or the valve stem guide and also prevents a separation of the entire seal from the valve stem or the valve stem guide.

A further aspect of the present disclosure relates to a valve stem assembly including a valve stem that is received and guided in a valve stem guide and a valve stem seal as discussed above.

Further advantages and advantageous embodiments are specified in the description, the drawings, and the claims. Here in particular the combinations of features specified in the description and in the drawings are purely exemplary, so that the features can also be present individually or combined in other ways.

In the following the invention is described in more detail using the exemplary embodiments depicted in the drawings. Here the exemplary embodiments and the combinations shown in the exemplary embodiments are purely exemplary and are not intended to define the scope of the invention. This scope is defined solely by the pending claims.

DETAILED DESCRIPTION

In the following, identical or functionally equivalent elements are designated by the same reference numbers.

Figure 1:
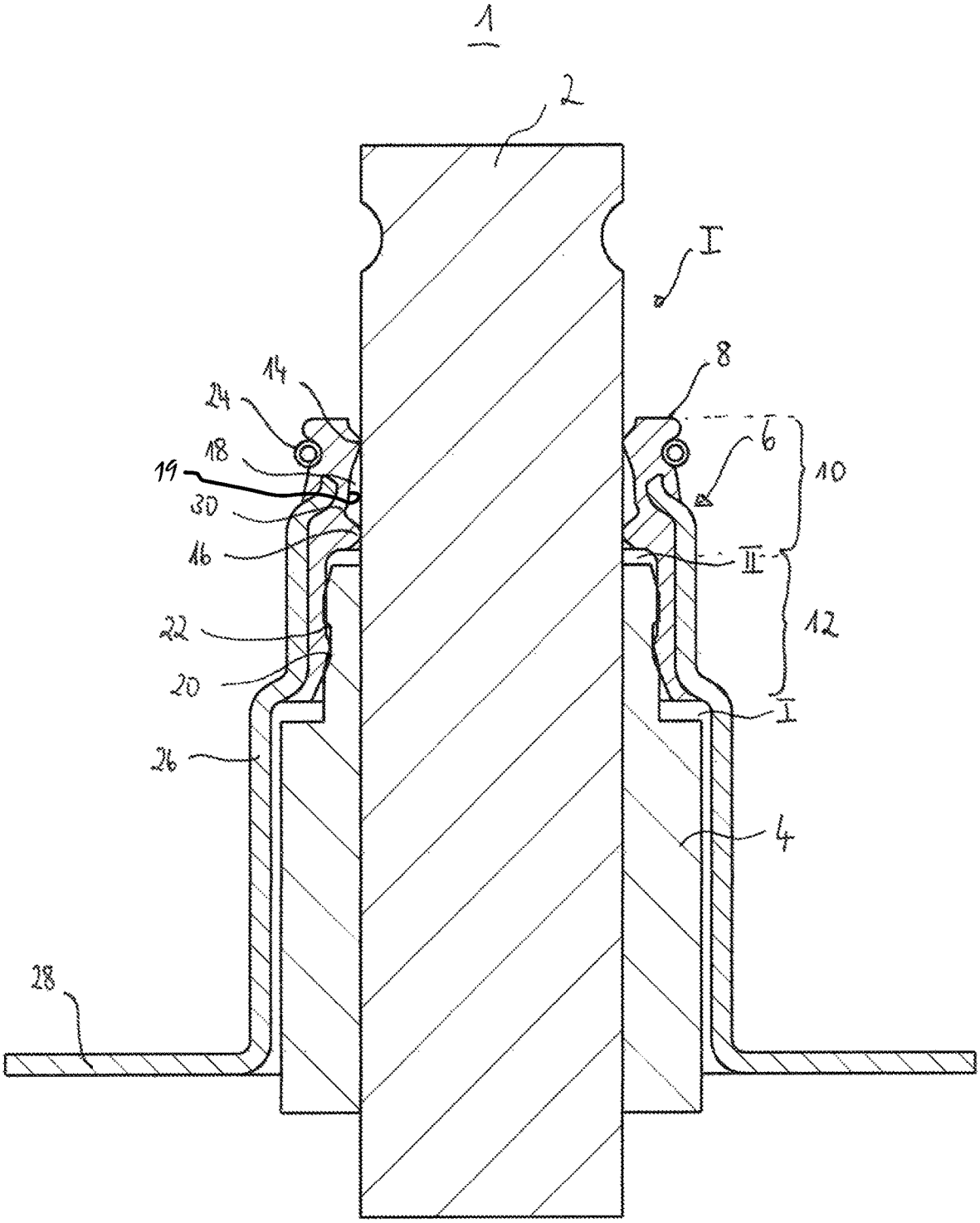
FIG. 1 is a schematic sectional view through a preferred exemplary embodiment of the a valve stem assembly according to the present disclosure.'

FIG. 1 schematically shows a valve stem assembly 1 including a valve stem 2 that is guided by a guide 4. Such a valve stem assembly 1 is present in internal combustion engines of automobiles and also trucks. Furthermore, the valve stem assembly 1 includes a valve stem seal 6 that is configured to separate an oil environment 1 from a gas space II. The seal assembly 6 includes a seal body 8 manufactured from an elastomer material, which seal body 8 includes a first seal body section 10 and a second seal body section 12.

As can furthermore be seen from FIG. 1, the first seal-body section 10 is configured to sealingly abut against the valve stem 2, and the second seal body section 12 is configured to seal against the valve stem guide 4. For this purpose, in the first seal-body section 10 the seal body 8 includes a first seal lip 14 and a second seal lip 16. Here the seal lip 14 is configured as so-called oil lip and the seal lip 16 as so-called gas lip since the oil lip seals against the oil space 1, and the gas lip 16 seals against the gas space II. Both seal lips 14, 16 abut against the valve stem 2 and between them form a free space 18 in which the seal body 8 is spaced from the valve stem 2. The free space 18 may be referred to as a radially inwardly facing "annular channel" having a surface 19 spaced from the valve stem.

On the second seal-body section 12 at least one seal rib 20 can furthermore be provided that is configured to engage in a receptacle 22, in particular in an undercut, provided on the valve guide 4. The valve stem seal 6 can thereby be fixed to the guide 4.

In order to furthermore increase the contact pressure of the oil lip 14, according to the exemplary embodiment depicted in FIG. 1, the seal assembly 6 furthermore includes a spring element 24, in particular a worm spring, which presses the seal lip 14 radially against the valve stem 2.

Furthermore, the seal assembly 1 includes a reinforcing element 26 that carries and stabilizes the seal body 8. Here the reinforcing element 26 is disposed radially on the radially outer side of the second seal-body section 12, and in the region of the first seal section 10 dips into the elastomer material of the seal body 8 approximately to the height of the second seal lip 16, and ensures a stable abutment of the seal lips 14, 16 against the valve stem 2, or of the seal lips 22 against the valve stem guide 4.

In the exemplary embodiment depicted, the reinforcing element is furthermore configured as seat for a valve spring (not depicted), and for this purpose includes, on its end facing away from the seal body 8, a radially extending flange 28 that serves as spring seat.

In normal combustion motor operation it is ensured by the arrangement of the oil lip 14 and the gas lip 16 that the gas space II and the oil space 1 are reliably separated from each other. However, if the motor is operated in a motor braking mode, the pressure in the gas space II greatly increases and presses against the gas lip 16, which deforms due to the pressure and vents gas toward the oil space 1 and through the oil lip 14. However, since this deformation is actually directed against the actual seal function, the elastomer material of the seal body 8 is thereby excessively loaded. Damage can thereby arise due to the tensile and compressive forces on the elastomer material, which is also increased by the reinforcing element 26, which further limits the movability of the seal lip 16.

In order to make possible a damage-free-as-possible deformation possibility of the seal lip 16 even at high pressures in the gas space II, an undercut 30, which may comprise a circumferential groove, is furthermore provided that is disposed on the second seal lip 16 in the region of the free space 18. This free space 18 and the undercut 30 can be seen in particular in the enlarged depiction of FIG. 2.

The undercut 30 allows a gentler deformation of the seal lip 16 toward the oil side I, and thus prevents damage to the elastomer material. In order to also direct the deformation toward the undercut 30, on its side facing the gas space II the seal lip 16 furthermore includes a slip incline 32, which is an angled edge, that is formed such that during force application the deformation of the seal lip in the undercut 30 is supported.

Figure 2:
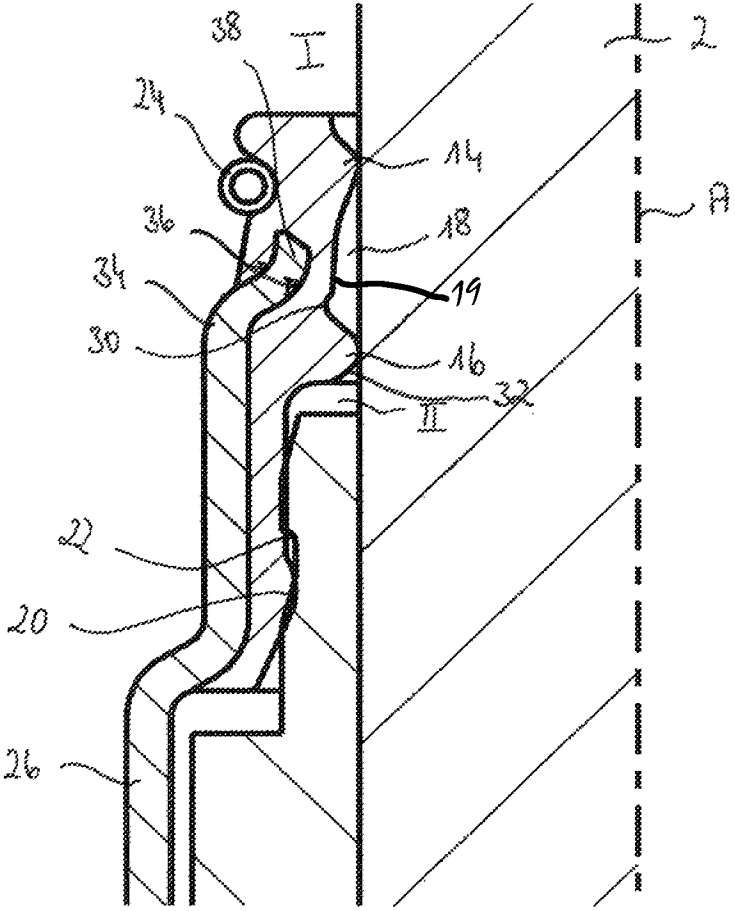
FIG. 2 is an enlarged detail view of a portion of the valve stem seal of FIG. 1.

Furthermore, FIG. 2 shows that in the region of the second seal lip 16, the reinforcing element 26 not only radially outwardly reinforces the elastomer material, but rather it is bent toward the valve stem 2 (see bending 34) and dips into the elastomer material of the seal body 8. In the region of the undercut or of the free space 18 the reinforcing element 26 is then completely embedded in the elastomer material.

In the exemplary embodiment depicted in FIG. 2, in the region where the reinforcing element 26 is embedded in the elastomer material, the reinforcing element 26 is furthermore angled (see bending 36) and extends in the region 38 essentially axially with respect to a valve stem axis A. Due to the bending 36, the deformation forces in the elastomer material are further deflected, so that in the event of a deformation of the seal lip 16 toward the oil side I, a load concentration of the elastomer material is thereby also reduced. It is advantageous here in particular when the bending 36 and the undercut 30 interact with each other and are adapted to each other in order to make possible a best-possible deformation of the seal lip 16.

At the same time, however, the basic orientation of the seal lip 16 toward the gas space II ensures that the main seal function of the seal lip 16 is directed toward the gas space II, and closes it off against a so-called "blowby" toward the oil side I.

A "blowby" is understood to mean the actual unwanted escape of gas from the gas space II toward the oil side I. At very high pressures that occur in particular in motor braking operation, however, this blowby is not to be prevented, or is even acceptable, since the gas can then escape without damaging the seal overall. Here the above-mentioned undercut 30 and the bending 36 make possible the damage-free deformation of the seal lip.

With the aid of the seal rib 20, which is in engagement with the receptacle 22, the gas space is sealed toward the valve guide 4. The receptacle 22 ensures that even with high pressures in the gas space II, the entire valve stem seal is not shifted toward the axial end 3 of the valve stem.

The flange 28, depicted in FIG. 1, of the reinforcing element also ensures that the valve stem seal 6 cannot be lifted off from the guide or the valve stem since the seal assembly 6 is secured in its position by the non-depicted valve spring.

Overall, with the presented valve seal or valve stem assembly, a valve stem seal can be provided that reliably prevents damage to the seal even with the deformation that arises in the presence of high pressures. Here the undercut configured for this purpose and the corresponding angling/bending of the reinforcing element ensure a receiving and deflecting of the pressure, compression, and tensile forces in the elastomer material so that an essentially damage-free deformation of the seal lip 16 is made possible.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved valve stem seals.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

1 Valve stem assembly
2 Valve stem
3 Axial end of the valve stem
4 Valve stem guide
5 Valve stem seal
8 Valve stem body
10 Valve-stem-body section
12 Valve-stem-body section
14 First seal lip (oil lip)
16 Second seal lip (gas lip)
18 Free space
20 Seal rib
22 Recess
24 Spring element

26 Reinforcing element
28 Flange
30 Undercut
32 Slip surface
34 First angled region
36 Second angled region
38 Axial extension
I Oil space
II Gas space
A Longitudinal axis of the valve stem

What is claimed is:

1. A valve stem seal for sealing a valve stem of an internal combustion engine, comprising:

an elastomeric annular seal body including a first seal body section configured to seal against the valve stem and a second seal body section configured to seal against a valve stem guide, and a reinforcing element having a first portion radially surrounding the second seal body section and a second portion at least partially embedded in the first seal body section, the second portion including an end of the reinforcing element, wherein the first seal body section includes an annular end portion axially spaced from the reinforcing element, wherein the first seal body section includes a first seal lip configured to sealingly abut against the valve stem to delimit an oil space and a second seal lip axially spaced from the first seal lip and configured to sealingly abut against the valve stem to delimit an air space, wherein the first seal body section includes a radially inwardly facing annular channel axially between the first seal lip and the second seal lip, the first seal body section being configured such that a surface of the channel is spaced from the valve stem when the valve stem seal is mounted on the valve stem, and wherein the surface of the channel includes an undercut configured to facilitate a deformation of the second seal lip toward the first seal lip.

2. The valve stem seal according to claim 1, wherein the second seal lip is configured as a gas-pressure-relief seal lip such that in the event of excess pressure in the air space the second seal lip is configured to deform in the undercut and open toward the channel.

3. The valve stem seal according to claim 1, wherein the second seal lip includes an angled edge in the gas space configured to facilitate a deformation of the second seal lip at the undercut.

4. The valve stem seal according to claim 1, including a worm spring on a radial outer side of the annular end portion of the first seal body configured to preload the first seal lip toward the valve stem.

5. The valve stem seal according to claim 4, wherein the reinforcing element directly contacts a radially outer surface of the second seal body section at a location radially outward of the second seal lip.

6. The valve stem seal according to claim 1, including a worm spring on a radial outer side of the annular end portion configured to preload the first seal lip toward the valve stem, wherein the second seal lip includes an angled edge in the gas space configured to facilitate a deformation of the second seal lip at the undercut, and wherein the second portion of the reinforcing element is angled radially inwardly and embedded in the first seal body section radially adjacent to the undercut.

7. A valve stem assembly comprising:

a valve stem guide, a valve stem slidably mounted in the valve stem guide, and the valve stem seal according to claim 1, wherein the first seal body section abuts the valve stem and the second seal body section abuts the valve stem guide.

8. The valve stem seal according to claim 1, wherein the reinforcing element is formed one-piece.

9. The valve stem seal according to claim 8, wherein the reinforcing element is configured as a seat for a spring surrounding the valve stem and includes a flange extending radially outwardly from the first portion of the reinforcing element at a location axially spaced from first seal body section.

10. The valve stem seal according to claim 9, including a worm spring on a radial outer side of the annular end portion configured to preload the first seal lip toward the valve stem.

11. The valve stem seal according to claim 10, wherein the reinforcing element is configured as a seat for a spring surrounding the valve stem and includes a flange extending radially outwardly from the first portion of the reinforcing element at a location axially spaced from first seal body section.

12. The valve stem seal according to claim 11, including a worm spring on a radial outer side of the first seal body section, axially spaced from the reinforcing element, configured to preload the first seal lip toward the valve stem.

13. The valve stem seal according to claim 12, wherein the first portion of the reinforcing element directly contacts a radially outer surface of the second seal body section.

14. A valve stem seal for sealing a valve stem of an internal combustion engine, comprising:

an elastomeric annular seal body including a first seal body section configured to seal against the valve stem and a second seal body section configured to seal against a valve stem guide, and a reinforcing element at least partially surrounding the annular seal body, wherein the first seal body section includes a first seal lip configured to sealingly abut against the valve stem to delimit an oil space and a second seal lip axially spaced from the first seal lip and configured to sealingly abut against the valve stem to delimit an air space, wherein the first seal body section includes a radially inwardly facing annular channel axially between the first seal lip and the second seal lip, the first seal body section being configured such that a surface of the channel is spaced from the valve stem when the valve stem seal is mounted on the valve stem, wherein the surface of the channel includes an undercut configured to facilitate a deformation of the second seal lip toward the first seal lip, wherein the reinforcing element includes a first portion radially surrounding an outer surface of the second seal body section and a second portion embedded in the first seal body section, and wherein the second portion includes a radially inwardly angled end portion radially adjacent to the channel.

15. The valve stem seal according to claim 14, wherein the radially inwardly angled end portion is radially adjacent to the undercut.

16. The valve stem seal according to claim 15, wherein the reinforcing element is configured as a seat for a spring surrounding the valve stem and includes a flange extending radially outwardly from the first portion of the reinforcing element at a location axially spaced from the radially inwardly angled end portion.

17. A valve stem assembly comprising:

a valve stem guide; and a valve stem slidably mounted in the valve stem guide, the valve stem seal according to claim 15, wherein the first seal body section abuts the valve stem and the second seal body section abuts the valve stem guide.

18. The valve stem seal according to claim 14, wherein the reinforcing element is formed one-piece.

* * * * *